United States Patent [19]

Kageyama et al.

[11] Patent Number: 4,682,076

[45] Date of Patent: Jul. 21, 1987

[54] MICROWAVE TUBE WITH IMPROVED OUTPUT SIGNAL EXTRACTING STRUCTURE

[75] Inventors: Takao Kageyama; Ryuzo Orui, both of Tokyo, Japan

[73] Assignee: NEC Corporation, Japan

[21] Appl. No.: 755,412

[22] Filed: Jul. 15, 1985

[30] Foreign Application Priority Data

Jul. 16, 1984 [JP] Japan ..... 59-147128

[51] Int. Cl.[4] ..... H01J 25/00

[52] U.S. Cl. ..... 315/4; 315/3.5; 315/5; 315/39.53; 333/34

[58] Field of Search ..... 315/4, 5, 3.5, 39.53; 333/34

[56] References Cited

U.S. PATENT DOCUMENTS

| | | | |
|---|---|---|---|
| 2,633,493 | 3/1953 | Cohn | 333/34 |
| 2,863,093 | 12/1958 | Arditi | 333/34 |
| 2,891,190 | 6/1959 | Cohn | 333/34 |

*Primary Examiner*—Leo H. Boudreau
*Assistant Examiner*—Michael Razavi
*Attorney, Agent, or Firm*—Laff, Whitesel, Conte & Saret

[57] ABSTRACT

A helix type traveling wave tube comprises an evacuated envelope containing an electron gun assembly at one end thereof for forming and projecting a beam of electrons over an elongated beam path to an electron collector electrode at the opposite end of the envelope. A helix slow-wave circuit is arranged along the beam path intermediate the electron gun and the beam collector for electromagnetic interaction with the beam. In order to extract an amplified signal from the downstream end of the slow wave circuit, there is provided an coaxial line including an outer conductor air-tightly fixed at one end thereof to the evacuated envelope and an inner conductor having one end connected to an output end of the slow wave circuit. An output waveguide is air-tightly fixed to the other end of the coaxial line outer conductor in such a manner the other end of the coaxial line inner conductor extending into the output waveguide. Further, a ceramic hollow cylindrical member is positioned in the output waveguide to surround the other end of the coaxial line inner conductor, and is air-tightly fixed at opposite ends thereof to an inner wall of the output waveguide.

10 Claims, 5 Drawing Figures

MICROWAVE TUBE WITH IMPROVED OUTPUT SIGNAL EXTRACTING STRUCTURE

BACKGROUND OF THE INVENTION

The present invention relates to microwave tubes such as traveling wave tubes, and more particularly to microwave tubes provided with an improved output signal extracting structure capable of outputting a high power electromagnetic signal over a wide frequency band.

DESCRIPTION OF RELATED ART

Various attempts have heretofore been made to develop high output power, wide band micrôwave tubes, and different types of microwave tubes are used at present. Among the microwave tubes being used at present, helix slow-wave circuit type traveling wave tubes are most suitable for amplification of microwave frequency band, since the helix type traveling wave tube have a very wide frequency band and can be manufactured at a relatively low cost.

Briefly, as shown in FIG. 1, the helix type traveling wave tube 1 comprises an evacuated envelope 2, of a copper, containing an electron gun assembly 3 at one end thereof for forming and projecting a beam of electrons over an elongated beam path 4 to an electron collector electrode 5 at the opposite end of the envelope 2. A helix slow-wave circuit 6 is arranged along the beam path 4 intermediate the electron gun 3 and the beam collector 5 for electromagnetic interaction with the beam. Input microwave signals to be amplified ar applied to the upstream end of the slow-wave circuit 6 via an input coaxial line 7, and amplified output signals are extracted from the downstream end of the slow wave circuit 6 via an output coaxial line 8. A periodic permanent magnetic arrangement 9 is coaxially disposed to surround the envelope 2 for producing an axially directed magnetic beam focusing field within the beam 4 so as to focus the beam through the helical slow-wave structure 6.

In the helix type traveling wave tube as mentioned above, in order to ensure the interior of the envelope in the vacuum condition, the input and output coaxial lines 7 and 8 have heretofore been hermetically sealed by locating an insulative ring 7A, 8A between inner and outer conductors of each coaxial line, as shown in FIG. 1. On the other hand, the output coaxial line 8 ordinarily has an outer conductor of a relatively small inner diameter for impedance matching with a possible waveguide to be connected to the output coaxial line 8. Therefore, if the traveling wave tube is driven so as to output a microwave signal of high power, the sealing insulative ring 8A in the output coaxial line has often been broken because the electromagnetic wave passes through the sealing ring 8A at a very high electric flux density and because high frequency discharges occur at the atmosphere side of the sealing ring 8A. Because of this, high power and wideband inherent to the helix type traveling wave tube could not have been exerted in the conventional construction.

In view of the above, and in order to provide a helix type traveling wave tube which has not only a high output power but also a wide frequency band and which can be fixed with a waveguide at a good matching over a wide frequency band, H. Satoh has proposed an output signal extracting structure as shown in FIG. 2, in which elements similar or corresponding to those shown in FIG. 1 are given the same Reference Numerals. The traveling tube shown includes a helix slow-wave circuit 6 supported in an evacuated envelope 2 by three dielectric rods 10, which is in turn located between the envelope 2 and the slow-wave circuit 6 at equal angular intervals, as shown in FIG. 3. Further, the envelope 2 is surrounded by the periodic permanent magnet arrangement 9 which comprises alternately arranged permanent magnets 11 and pole pieces 12.

An output end of the helix 6 is connected to one end of an inner conductor 13 which cooperates with an cylindrical outer conductor 14 to constitute a coaxial line. The outer conductor 14 is air-tightly fixed at its one end to the envelope 2 and at its other end to a waveguide 15, which in turn has an enlarged portion 16 air-tightly fitted with a ceramic dielectric window plate 17 so as to maintain the interior of the envelope 2 in a vacuum condition and at the same time to allow the electromagnetic wave to pass through the sealing window plate 17.

With the above construction, since the air-tight-sealing dielectric window plate 17 is made large, the electric flux density of the electromagnetic wave passing through the window plate 17 is made small, so that it would not be broken even if the traveling wave tube is driven at a large power. On the other hand, the coaxial line can have the outer conductor of the inner diameter required for impedance matching with the waveguide over a larger operating frequency band.

However, another problem has been raised that the window plate 17 itself located in the waveguide 15 cannot provide a larger transmission frequency band corresponding to the operating frequency band of the traveling wave tube itself. Specifically, in the case that the enlarged portion 16 of the waveguide 15 is in the form of a pill-box as shown in FIG. 2, since the enlarged portion 16 can have a resonance mode of very high Q, the window plate 17 is in danger of break or damage when it resonates in such a mode. Because of this, the transmission band has to be limited. In addition, even if the waveguide portion provided with the window plate is brought into the form of an inductive iris, the transmission band cannot exceed about 20% in the relative bandwidth $\Delta f/f_o$ ($f_o$=center operating frequency and $\Delta f$=operating frequency bandwidth).

The above inconvenience is an unavoidable problem not only in the helix type traveling wave tube but also in the other microwave tubes including the other type traveling wave tubes, although it is particularly very serious to the helix type traveling wave tube.

SUMMARY OF THE INVENTION

Accordingly, it is an object of the present invention to provide a microwave tube with an improved output signal extracting structure which has a wider transmission band and which allows transmission of a high power electromagnetic wave at a good impedance matching without damage of the output structure.

Another object of the present invention is to provide a helix type traveling wave tube with an improvd output signal extracting structure which has a wider transmission band substantially corresponding to the frequency bandwidth of the traveling wave tube itself and which permits to output a high power electromagnetic wave at a good impedance matching without a substantial loss and without damage of the output structure.

The above and other objects of the present invention are accomplished by a microwave tube of the type which includes an evacuated envelope containing an electron gun means located at one end thereof for providing a beam of electrons and a collector means located at the other end of the evacuated envelope for collecting the electron beam from the electron gun means, means at the upstream side of the electron beam for applying a microwave signal to the electron beam, and means at the downstream side of the electron beam for extracting an amplified output signal from the electron beam. In such a microwave tube, and in accordance with the present invention, the output signal extracting means comprises a coaxial line including an outer conductor air-tightly fixed at one end thereof to the evacuated envelope and an inner conductor having one end extending into the evacuated envelope at an angle to the center axis of the electron beam, and an output waveguide air-tightly fixed to the other end of the coaxial line outer conductor such that the other end of the coaxial line inner conductor extends into the output waveguide. Furthermore, the output signal extracting means includes a dielectric hollow cylindrical member positioned in the output waveguide to surround the other end of the coaxial line inner conductor, and the cylindrical member is air-tightly fixed at opposite ends thereof to an inner wall of the output waveguide.

In a preferable embodiment of the microwave tube in accordance with the present invention, the cylindrical member is made of ceramic. In addition, the output waveguide includes a resistive ridge formed on an inner wall surface thereof to oppose the inner conductor of the coaxial line, and the cylindrical member is air-tightly fixed at its one end to the inner wall of the output waveguide and at its other end to the ridge formed in the output waveguide. In such a case, the other end of the coaxial line inner conductor is preferably connected to the ridge formed in the output waveguide.

Furthermore, the microwave tube is preferably of the helix type traveling wave tube which includes a helix slow-wave circuit located in the evacuated envelope in such a manner that the electron beam passees through the slow-wave circuit to the collector. In this case, the one end of the coaxial line inner conductor is preferably connected to one end of the slow-wave circuit.

The above and other objects and features of the present invention will be apparent from the following description of a preferred embodiment of the invention with reference to the accompanying drawings.

DESCRIPTION OF THE PREFERRED EMBODIMENT

Figure 3:
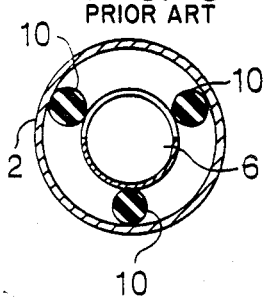
FIG. 3 PRIOR ART
FIG. 3 is a transverse sectional view of the envelope of the traveling tube shown in FIG. 2 but omitting the surrounding magnetic arrangement.
Figure 4:
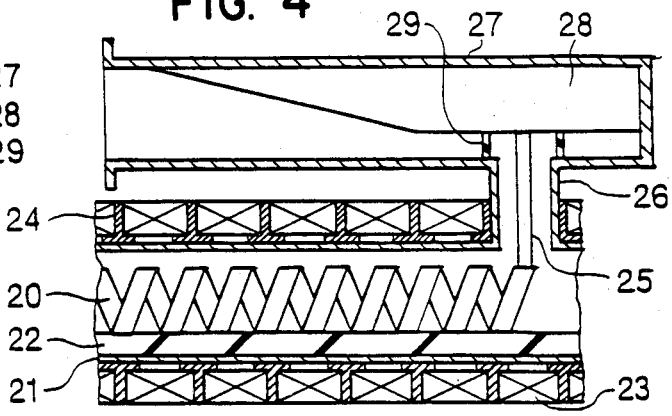
FIG. 4 is a view similar to FIG. 2 but showing a helix type traveling wave tube provided swith an output signal extracting structure in accordance with the present invention.

Referring to FIG. 4, there is shown in the form of a schematic longitudinal sectional view an output signal extracting structure constructed in accordance with the present invention and incorporated to a helix type traveling wave tube. The traveling tube shown includes a slow wave circuit consisting of a helix 20, which is in turn located in an evacuated metal envelope 21 and supported by dielectric rods 22 located between the helix 20 and the envelope 21 in such a manner as shown in FIG. 3. The envelope 21 is surrounded by a periodic permanent magnet arrangement composed of alternately arranged permanent magnet 23 and pole pieces 24.

Figure 5:
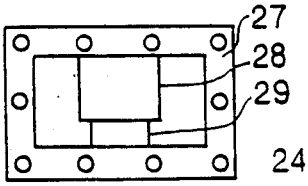
FIG. 5 is a left side view of the waveguide of the output structure shown in FIG. 4.

Further, to an output end of the helix 20 is connected one end of an inner conductor 25 perpendicular to the center axis of the electron beam. The inner conductor 25 is surrounded by a concentric cylindrical outer conductor 26 to constitute a coaxial line. The outer conductor 26 is air-tightly fixed at its one end to the envelope 21 and at its other end to a rectangular output waveguide 27, which is in turn located to have a center axis lying in a plane perpendicular to the inner conductor 25. The waveguide 27 has a tapered rectangular-block shaped resistive ridge 28 formed on an inner surface of the side wall thereof opposite to the side wall fixed with the other end of the outer conductor 26. The other end of the inner conductor 25 is connected to a flat portion of the ridge 28. Furthermore, a dielectric hollow cylindrical member 29 made of ceramic is located to coaxially surround a portion of the inner conductor positioned in the waveguide 27, and is air-tightly fixed at its one end to the inner wall of the wave guide 27 and at its other end to the ridge 28, as shown in FIG. 5.

Figure 1:
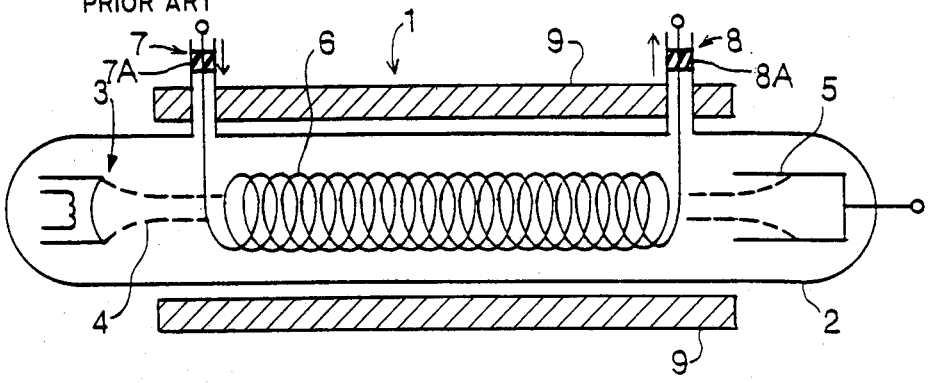
FIG. 1 PRIOR ART
FIG. 1 is a schematic longitudinal sectional view of a conventional helix type traveling wave tube.
Figure 2:
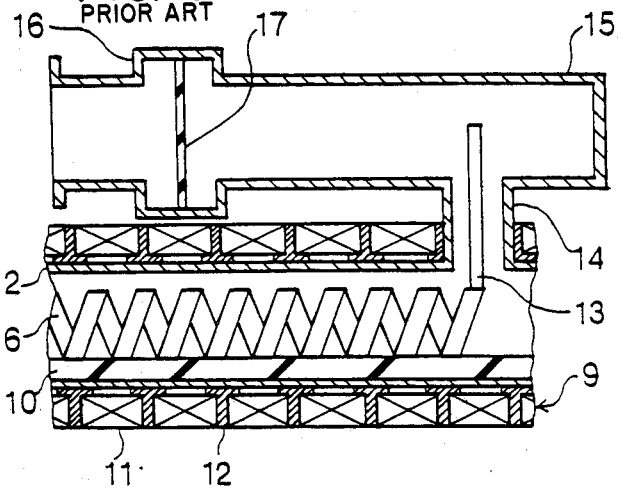
FIG. 2 PRIOR ART
FIG. 2 is a partial schematic longitudinal sectional view of a helix type traveling wave tube having an output signal extracting structure in accordance with the prior art.

With the arrangement mentioned above, since the cylindrical sealing member 29 can have a large area similarly to the large circular sealing window plate 17 in the pill-box portion of the waveguide as shown in FIG. 2, the electric flux density of the electromagnetic wave passing through the sealing member is small, so that it is free from the danger of break of damage of the dielectric sealing member when a high power is outputted from the traveling wave tube. In addition, since the connection portion of the waveguide provided with the dielectric sealing member has no pill-box shaped portion, it does not have a resonance mode of high Q. Therefore, there is no fear of break or damage caused by resonance of the waveguide.

Furthermore, the impedance matching between the coaxial line 25, 26 and the waveguide 27 is facilitated by the provision of the ridge 28, since the distributed impedance can be changed along the axis of the waveguide by suitably selecting the height and the inclination of the ridge 28. In addition, the connection portion of the waveguide with the coaxial line can have a decreased impedance because of the dielectric cylindrical member 29 located to surround the inner conductor 25. As a result, the output structure shown and hence the traveling wave tube having such an output structure can have a large relative bandwidth $\Delta f/f_0$ of about 30 to 40%.

Moreover, since the helix 20 is connected through the inner conductor 25 to the ridge 28 formed on the waveguide wall, the heat can be effectively removed from the helix 20. Therefore, the heat dissipation from the helix 20 is improved.

The invention has thus been shown and described with reference to the specific embodiment. However, it should be noted that the invention is in no way limited to the details of the illustrated structure but changes and modifications may be made within the scope of the appended claims. Particularly, the connection structure between the coaxial line and the waveguide should not be limited to the shown embodiment. For example, the output waveguide can be brought into a stepped type so as to decrease the height of the connection portion of the waveguide with the coaxial line.

We claim:

1. A microwave tube of the type which includes an evacuated envelope containing an electron gun means located at one end thereof for providing a beam of electrons and a collector means located at the other end of the evacuated envelope for collecting the electron beam from the electron gun means, means at the upstream side of the electron beam for applying a microwave signal to the electron beam, and means at the downstream side of the electron beam for extracting an amplified output signal from the electron beam, characterized in that the output signal extracting means comprises a coaxial line including an outer conductor air-tightly fixed at one end thereof to the evacuated envelope and an inner conductor having one end extending into the evacuated envelope at an angle to the center axis of the electron beam; an output waveguide air-tightly fixed to the other end of the coaxial line outer conductor, the output waveguide including a resistive ridge formed on an inner wall surface thereof to oppose the inner conductor of the coaxial line, the other end of the coaxial line inner conductor extending into the output waveguide and being connected to the ridge formed in the output waveguide; and a dielectric hollow cylindrical member positioned in the output waveguide to surround the other end of the coaxial line inner conductor, the cylindrical member being air-tightly fixed at its one end to the inner wall of the output waveguide and at its other end to the ridge formed in the output waveguide.

2. A microwave tube as claimed in claim 1 wherein the cylindrical member is made of ceramic.

3. A microwave tube as claimed in claim 1 wherein the cylindrical member is made of ceramic.

4. A microwave tube as claimed in claim 1 further including a slow-wave circuit located in the evacuated envelope in such a manner that the electron beams passes through the slow-wave circuit to the collector, and wherein the one end of the coaxial line inner conductor is connected to one end of the slow-wave circuit.

5. A microwave tube as claimed in claim 4 wherein the slow-wave circuit is of the helix type.

6. A microwave tube as claimed in claim 4 wherein the output waveguide includes a resistive ridge formed on an inner wall surface thereof to oppose the inner conductor of the coaxial line, and wherein the cylindrical member is air-tightly fixed at its one end to the inner wall of the output waveguide and at its other end to the ridge formed in the output waveguide.

7. A microwave tube as claimed in claim 6 wherein the other end of the coaxial line inner conductor is connected to the ridge formed in the output waveguide.

8. A microwave tube as claim in claim 7 wherein the cylindrical member is made of ceramic.

9. A helix slow-wave circuit type travelling wave tube which includes an evacuated envelope containing an electron gun means located at one end thereof for providing a beam of electrons and a collector means located at the other end of the evacuated envelope for collecting the electron beam provided by the electron gun means, a helix slow-wave circuit located in the evacuated envelope in such a manner that the electron beam passes through the slow-wave circuit to the collector, means at an upstream side of the electron beam for applying a microwave signal to the slow-wave circuit, and means at a downstream side of the electron beam for extracting an amplified output signal from the slow-wave circuit, said circuit being characterized in that the output signal extracting means comprises a coaxial line including an outer conductor which is air-tightly fixed at one end thereof to the evacuated envelope and an inner conductor having one end connected to one end of the helix slow-wave circuit at an angle to the center axis of the electron beam; an output waveguide which is air-tightly fixed to the other end of the coaxial line outer conductor so that the other end of the coaxial line inner conductor extends into the output waveguide; a resistive ridge formed on an inner wall surface of the output waveguide to oppose the inner conductor of the coaxial line, a dielectric hollow cylindrical member positioned in the output waveguide to surround the other end of the coaxial line inner conductor, the cylindrical member being air-tightly fixed at its one end to the inner wall of the output waveguide and at its other end to the ridge formed in the output waveguide, and the other end of the coaxial line inner conductor being connected to the ridge formed in the output waveguide.

10. A microwave tube as claimed in claim 9 wherein the cylindrical member is made of ceramic.

* * * * *